United States Patent [19]

von Meer

[11] 4,327,174

[45] Apr. 27, 1982

[54] METHOD OF PREPARING A CARRIER MATERIAL FOR PHOTOGRAPHY

[75] Inventor: Walter von Meer, Bad Iburg, Fed. Rep. of Germany

[73] Assignee: Felix Schoeller, Jr., Osnabrück, Fed. Rep. of Germany

[21] Appl. No.: 157,718

[22] Filed: Jun. 9, 1980

Related U.S. Application Data

[63] Continuation of Ser. No. 878,977, Feb. 17, 1978, abandoned, which is a continuation-in-part of Ser. No. 674,179, Apr. 6, 1976, abandoned.

[30] Foreign Application Priority Data

Apr. 11, 1975 [DE] Fed. Rep. of Germany ..... 2515823

[51] Int. Cl.[3] ..... G03C 1/87

[52] U.S. Cl. ..... 430/530; 162/50; 162/135; 162/138; 427/45.1; 428/342; 428/508; 428/509; 430/531; 430/538

[58] Field of Search ..... 162/135, 138, 50, 192, 162/180, 181 A, 175, 160, 176, 158; 427/45, 301, 303, 209, 395, 45.1; 430/496, 525, 631, 538, 527, 531; 428/508, 513, 913, 537, 342, 509, 536; 219/10.55 M; 34/1, 4, 39

[56] References Cited

U.S. PATENT DOCUMENTS

| | | | |
|---|---|---|---|
| 3,748,204 | 7/1973 | Murayama et al. | 156/244 |
| 3,853,592 | 12/1974 | Crawford et al. | 430/538 X |
| 3,873,354 | 3/1975 | Walters | 162/138 X |
| 3,884,692 | 5/1975 | Minagawa | 430/538 X |
| 3,902,959 | 9/1975 | De Matte | 162/173 |

*Primary Examiner*—Ralph S. Kendall
*Assistant Examiner*—Thurman K. Page
*Attorney, Agent, or Firm*—Edwin E. Greigg

[57] ABSTRACT

This invention relates to a carrier material for photographic purposes which is formed of paper coated with a synthetic resin. The paper contains a water soluble inorganic salt that enhances its drying by microwaves. In a preferred embodiment, the paper contains starch.

18 Claims, 5 Drawing Figures

METHOD OF PREPARING A CARRIER MATERIAL FOR PHOTOGRAPHY

REFERENCE TO RELATED APPLICATIONS

This is a continuation, of application Ser. No. 878,977 filed Feb. 17, 1978 which is a continuation-in-part of Ser. No. 674,179 filed Apr. 6, 1976, both now abandoned.

BACKGROUND OF THE INVENTION

This invention relates to a paper carrier material for photography which is coated with a synthetic resin and which can be dried by using microwave radiation.

It is known that paper strips can be dried with microwave radiation and that photographic papers can also be dried using microwaves after exposure and processing in the usual photographic baths. This technique is used particularly when rapid heating of the material being dried is desirable. An advantage of microwave drying is that energy absorption is directly proportional to the water content of the paper.

It is known that photographic papers coated with polyethylene can be treated with salts, e.g. the sodium salt of naphthalene-sulphonic acid or $Na_2SO_4$ (British Pat. Nos. 1,019,664 and 1,346,960). This treatment is for the single purpose of preventing a critical accumulation of electrostatic charge in high-speed processing machines, because the accumulated charge can interfere in the transport of the paper or can cause undesirable exposure of adjacent photographic layers by the formation of sparks.

Chu et al. (U.S. Pat. No. 3,253,922) discloses photographic paper coated with polyethylene which has been treated to reduce the formation of static charges. This is accomplished by incorporating in the paper base an antistatic agent, e.g., sodium sulfate, salts of organic compounds, and organic antistatic agents, including trialkanolamine alkanoates and polyalkylane polyamine derivatives.

Seel (U.S. Pat. No. 1,434,453) teaches the use of an inert metal salt and a hydroscopic organic compound in a nitrocellulose support for photographic film.

Inclusion of a deliquescent salt, e.g., $CaCl_2$, $MgCl_2$, or LiCl, in a resin-coated paper, whereby the water content of the paper substrate is held at 6–10% during manufacture and the paper is prevented from curling, is disclosed in German Offenlegungsschrift No. 2,235,032 (Jan. 25, 1973).

Verburg (U.S. Pat. No. 3,769,020) provides a photographic material having a backing layer of polyolefin on both sides, the rear surface of one polyolefin layer carrying an antistatic layer, e.g., polystyrene sulfonic acid in a resin.

Dippel et al. (U.S. Pat. No. 2,588,218) treat dry photographic material of regenerated cellulose by heating in a high frequency electric field and passing a stream of gas over the material.

Minagawa (U.S. Pat. No. 3,884,692) teaches the application of a coating of colloidal alumina to the back of a polyolefin laminated paper support for light-sensitive photographic material to prevent the paper from blistering during drying by microwave heating.

The advantages of microwave drying have not heretofore been to any great extent for drying photographic papers coated with a synthetic resin, because it is not practical to raise the water content of photographic papers too high. For example, when water content attains equilibrium at 70% relative humidity or more, increase growth of fungus and bacteria can be observed and results in paper having a mottled appearance and being partially destroyed. In addition, the influence of dampness on photographic layers containing silver salts is apparent even through layers of a synthetic resin. The water content of the paper core influences adhesion, hardening and the sensitometric properties of the photographic layers. When such layers are to be used in color photography, the presence of this water manifests itself in the form of undesirable color changes. Therefore, in base papers for photographic purposes the water content is carefully adjusted to a constant value, preferably corresponding to an equilibrium water content at 50% relative atmospheric humidity or less. Only in exceptional cases are equilibrium humidities which correspond to 55% or a maximum of 60% relative humidity preferable.

The energy absorption observed when microwaves are used is influenced not only by the water content, but to a lesser degree by components in the paper. The amount of these additional materials and their dielectric constants have the most important influence. If the water content of the paper is constant, the effect of these additives at low concentration is very small, since their dielectric constants are generally very much smaller than that of the water. Only mineral fillers are an exception to this rule. However, it is not advantageous to use these fillers because of the irregular energy absorption caused by their distribution in the paper and their microscopic particle structure.

OBJECT AND SUMMARY OF THE INVENTION

It is an object of this invention to provide an improved, highly efficient method of drying resin-coated photographic papers by microwave radiation and the papers thus produced.

It has been found, in accordance with the invention, that drying of resin-coated photographic papers by microwave radiation is enhanced to an unexpected extent by inclusion of a non-hygroscopic alkali metal halide and starch in the coated resin base.

This invention relates, in a method of drying paper containing a water-soluble non-hygroscopic salt by microwave radiation, to the improvement wherein the paper contains 0.25–5 grams of starch per square meter of paper.

In another aspect, this invention relates to photographic paper prepared as above.

The invention will be better understood as well as further objects and advantages thereof become more apparent from the ensuing detailed description of the invention taken in conjunction with the drawings.

BRIEF DESCRIPTION OF THE DRAWINGS

In FIG. 1 (bottom) is shown the relationship between the surface temperature of starch-containing raw paper exposed to microwaves as a function of the water soluble inorganic salt content;

DETAILED DESCRIPTION

Improved drying of paper is observed when the paper contains more than 0.3 percent by weight, in relation to the weight of the paper, of a soluble inorganic salt, e.g., an alkali metal halide. This result is surprising, because the dielectric constant of NaCl is very small, i.e., 6.1, whereas the dielectric constant of water is approximately 80.

The basic theory of microwave heating is that the energy absorbed by any kind of material by irradiation with microwaves is expressed by the equation:

$$P=\tfrac{1}{2}(2\pi f E E_o \tan\delta+\sigma)E^2 W/m^3$$

wherein

P=absorbed energy f=microwave frequency

E=dielectric constant $E_o$=dielectric constant of vacuum ($10^{-11}$)

tan $\delta$=dielectric loss factor $\sigma$=microwave electric field·strength (volt/m)

"Paper Trade Journal" vol. 154, (1970), No. 39, at 38.

Thus, in a given high frequency device with a certain frequency, performance and electrode design, the absorbed energy is proportional to the conductivity of the material being heated and to its dielectric characteristics.

Figure 2:
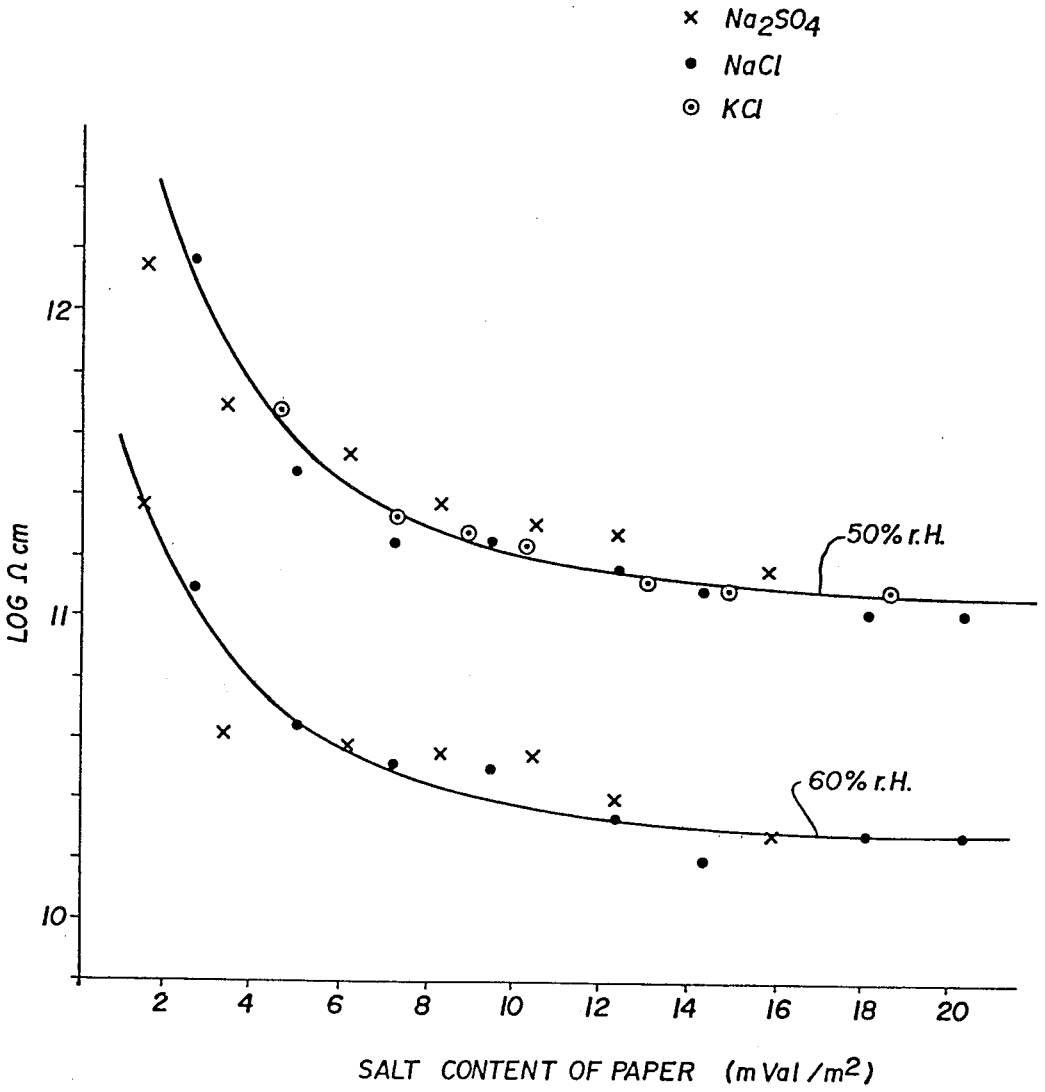
In FIG. 2 is shown the relationship between specific conductivity and salt content of papers containing various salts.

As shown in FIG. 2, papers with comparable conductivity rates were obtained using electrochemically equivalent quantities of various salts. The dimensions of the abscissa, mVal/m$^2$=ion-milligram equivalent/m$^2$, reflect this relationship. It will be apparent from FIG. 2 that specific conductivity is essentially independent of the salt selected, at electrochemically equivalent amounts. This is observed for NaCl, KCl and $K_2SO_4$ and at both 50% and 60% relative humidity.

Figure 3A:
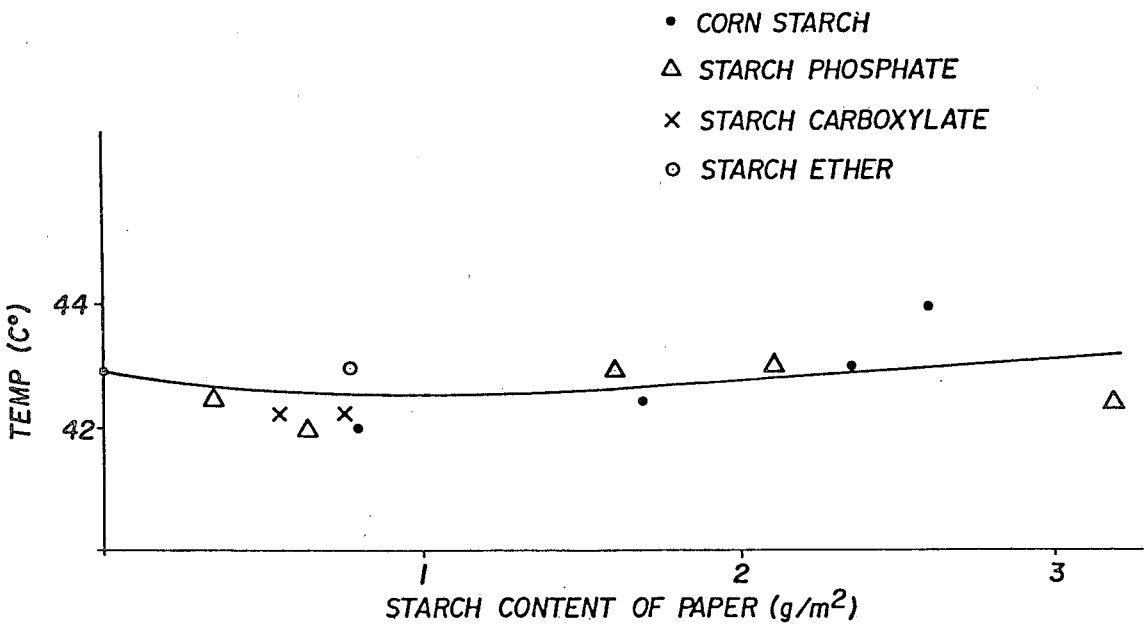
In FIG. 3A is shown the relationship between surface temperature and starch content of paper containing starch and subjected to microwave irradiation; and In FIG. 3B is shown the relationship between surface temperature and salt content of paper subjected to microwave irradiation.
Figure 3B:
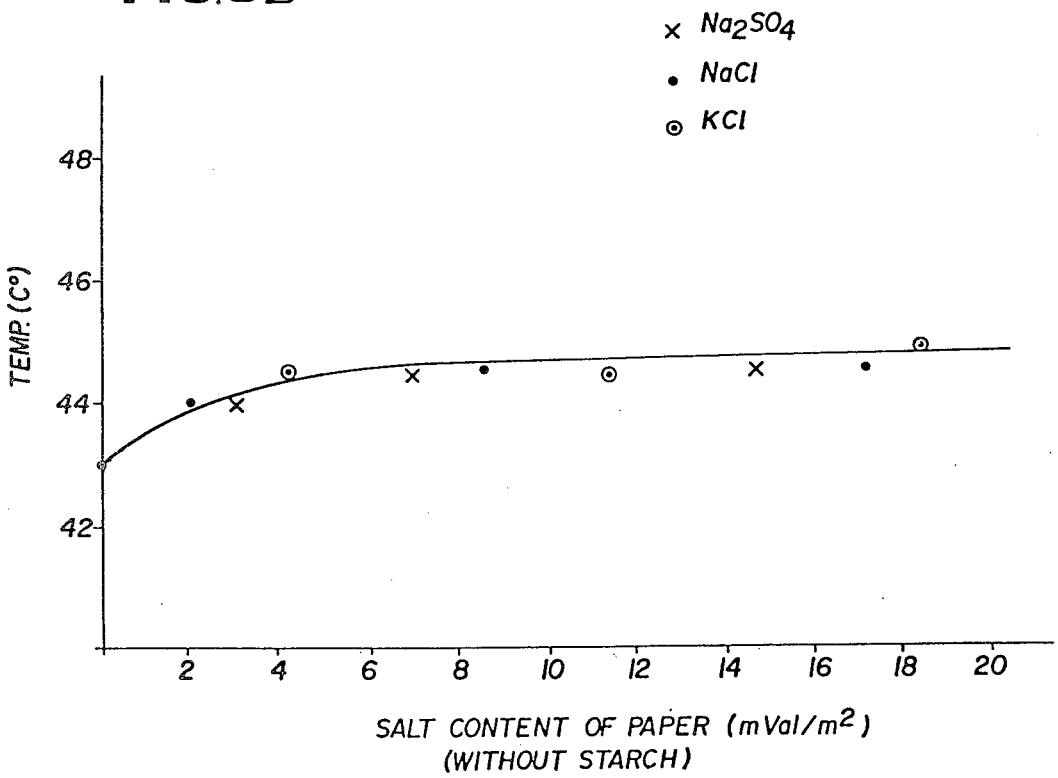

In FIG. 3A is shown the relationship between temperature of microwave irradiated paper and various concentrations of each of four types of starches. The relationship indicates that starches alone have almost no effect on energy absorption. A similar result is shown in FIG. 3B, which reflects the relationship between temperature of microwave irradiated paper and salt content.

Figure 1:
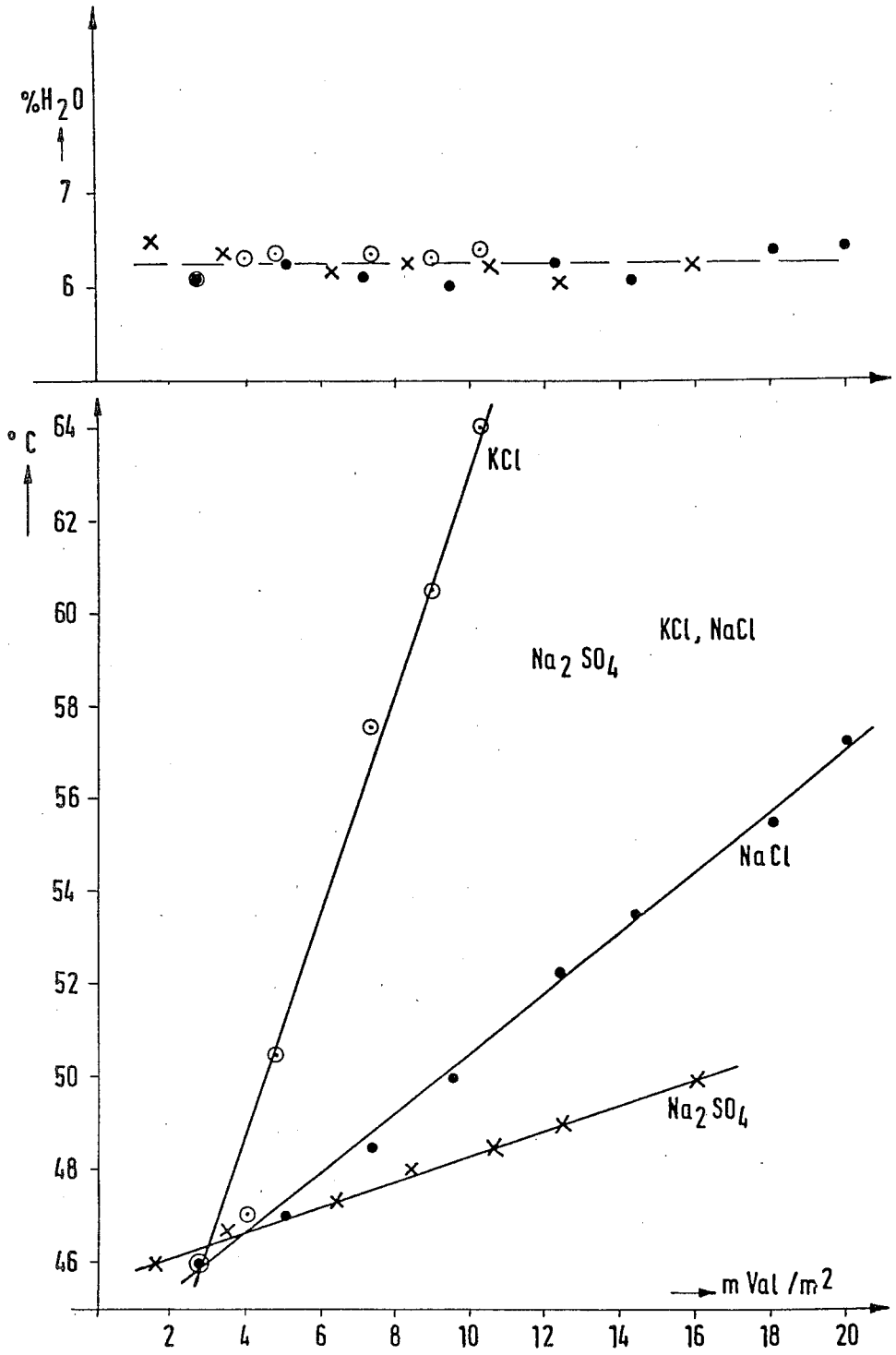
In FIG. 1 (top) is shown the relationship of the water content of raw paper as a function of the water soluble inorganic salt content contained therein.

In the top of FIG. 1 is shown the relationship between salt content and water content of papers containing non-hygroscopic salts. It is apparent that salt content does not influence water content.

Therefore, both the conductivity factor (FIG. 2 and 3A) and water content (FIG. 1, top) are excluded as having substantial effects on heating effect of paper treated by microwave radiation.

In FIG. 1 (lower portion) is shown the heating effect of paper containing 2,5 grams/square meter of starch and various salt concentrations. It will therefore be understood that particularly dramatic effects are observed in papers containing both starch and a non-hygroscopic alkali metal halide, i.e., NaCl or KCl.

The invention is applicable to any kind or thickness of paper, but paper for photographic uses, art paper, etc. having smooth surfaces and weighing 100 g/m$^2$ to 300 g/m$^2$ will be generally preferred.

The synthetic resins which can be laminated to the paper include, but are not limited to polyolefins, polycarbonates, polyesters, flexible polyacrylates and poly (vinyl halides). Polyolefins are preferred for reasons of economy.

Polyolefins used in this invention are polyethylene, polypropylene and mixtures thereof in any proportion.

Polyethylene and polypropylene may be selected from those of the prior art, and their equivalents, which have been used to form polyolefin laminated papers. The improved results of the present invention are achieved with any of such materials. Preferably, the polyethylene selected has a melt index of about 1 to about 30 and a density of about 0.91 to about 0.97, and polypropylene a melt index of about 0.1 to about 20 and a density of about 0.88 to about 0.91. These ranges merely serve as guidelines to one skilled in the art, and are not to be construed as limitative.

The polyolefin or aother synthetic resin can be used in various thicknesses, but at thicknesses much less than 1$\mu$ insufficient water-proofing may be achieved. Generally, there is no need to use a thickness much greater than 100$\mu$.

Polyolefin-laminated papers are usually prepared by casting molten polyolefin onto a running paper base, i.e., the extrusion coating method, whereby either or both sides of the paper are laminated or coated with polyolefin. Depending on the intended use of the final product, the surface of the polyolefin-laminated paper to which an emulsion will be applied can be glossy, matted, silk-like, etc. The back of the laminated paper is usually non-glossy.

"Water-soluble, non-hygroscopic salt," as used in the specification and claims include inorganic salts which dissolve in water to at least 1% by weight and which, when a component of art or photographic quality paper, do not cause the water content of the paper, under equilibrium conditions at 50% relative humidity, to exceed about 7% by weight.

Exemplary of salts which are water-soluble and non-hydroscopic are KCl, NaCl, $Na_2SO_4$, NaBr, KBr. Salts which are water-soluble but considered excessively hygroscopic for inclusion in photographic papers are $MgCl_2$, $MgSO_4$, $CaCl_2$, $ZnCl_2$, LiCl.

The quantity of salt included in the papers of this invention are from 2–20 meq/square meter of paper. When $Na_2SO_4$ is used, levels of 40–20 meq/m.$^2$ are preferred. For NaCl, levels of 5–30 meq/m.$^2$ and for KCl, 2–20 meq/m.$^2$. It will be apparent that KCl and NaCl are preferred for the practice of the invention, and that KCl is most preferred.

Alternatively, the amount of added salt will be 0.3–3% by weight of the paper, preferably up to 2.5% by weight of an alkali chloride.

"Starch," as used in the specification and claims, includes corn starch, wheat starch, purified starch and modified starches, of which starch phosphate, carboxylated starch and starch ethers. These materials are of the types discussed in Whistler and Paschall: "Starch: Chemistry und Technology" (New York 1965).

The amount of starch added to the papers is from 30–500% by weight of the salt (or salt mixture) used, that is 0.25–5 grams/square meter of paper. This will correspond to 0.3–6% by weight of the paper.

Preferably, the amount of starch is 2–5 grams/square meter and the starch is an oxidized corn starch.

The microwave radiation can be any known to have an adequate drying effect, commercially available microwave sources having a frequency of 10–2500 MHz. (The preferred range for use in paper drying is a frequency of 10–300 MHz.) Addition of conventional additives, such as pigments, polymer dispersions, paste or synthetic surface adhesive substances to the papers of this invention has no adverse effect on the drying behavior thereof.

It is therefore apparent that salt content above 2.5 percent by weight is not required in order to achieve the desired effect. A paper is obtained, which is obviously heated more by microwave radiation than paper with the same humidity content produced in the usual way.

EXAMPLE I

FIG. 1 is a graphical representation of the water content of untreated papers (top figure) as a function of the KCl, NaCl and $Na_2SO_4$ content of the paper. In this figure (bottom) the surface temperature of paper containing grams of 2.5 corn starch per square meter of paper and varying amounts of an inorganic salt was measured after heating with microwaves (35 MHz). In each case, the amount of NaCl, KCl, and $Na_2SO_4$ indicated in the figure was added, respectively, to 190 g/m$^2$ base paper, both sides of which were then coated with polyethylene, to a thickness of 35$\mu$, after which the paper was tested.

The salts were applied in a paper machine by a size press as an aqueous solution, which contained starch for the tests represented in the lower figure.

The legends mVal/m$^2$ identifying the abscissa of the graph means: m=milli, Val the gram-equivalent mass of a substance and m$^2$ square meter.

EXAMPLE II

Specific volume resistivities of papers weighing 190 grams/meter$^2$ and containing one of $Na_2SO_4$, NaCl or KCl and 2.5 g/m$^2$ corn starch were measured at 50% and 60% relative humidity using a Teraohmmeter type H 24 (manufactured by Knick, Berlin 37, W-Germany) and working according to ASTM D257-75a. The papers were impregnated with salts and starch as in Example I. The results are shown in FIG. 2. This is intended to demonstrate that when using ionic equivalent quantities of different salts the conductivity of the paper is independent of the type of salt used.

EXAMPLE III

One trial series of paper weighing approximately 190 grams/meter$^2$ was impregnated with one of corn starch, starch phosphate, carboxylated starch, starch ether in amounts from 0.4–3.2 g starch per square meter. The other trial series of paper was impregnated with KCl, NaCl or $Na_2SO_4$ in amounts of from 2–18 meq per square meter. Both of the trial series are subsequently coated with polyethylene and irradiated with microwaves (35 Mhz) as in Example I. The resulting temperatures of starch-treated papers are shown in FIG. 3A and of salt-treated papers in FIG. 3B. This is intended to demonstrate the minimum effect obtainable by exclusive use of either starch or salts. On the other hand, FIG. 1 demonstrates the synergistic effect which according to the invention is obtained by combined use of starch and alkali salts.

The preceding examples can be repeated with similar success by substituting the generically or specifically described reactants and/or operating conditions of this invention for those used in the preceding examples. In a preferred application of the invention photographic base paper weighing between 60 and 200 grams per square meter is treated on both sides, by means of a size press in the paper machine, with an aqueous solution containing a combination of 2–10 weight-% of starch or starch derivate and 1–10 weight-% sodium chloride. This is specifically demonstrated by the following Example IV.

EXAMPLE IV

Paper weighing approximately 170 grams/meter$^2$ was treated in the size press of a paper machine with an aqueous solution containing 7 weight-% of oxidized corn starch ("COLLOFILM 2A" manufactured by Scholten's Chemische Fabrieken, Netherlands) and 7 weight-% of sodium chloride. After drying, the salt and starch containing paper is coated on both sides with polyethylene (e.g. as described in U.S. Pat. No. 3,411,908). Subsequently the coated paper, whose moisture content was in equilibrium at 50% r.H, was treated for 30 seconds with microwaves of 35 MHz whereupon immediately the surface temperature of paper was measured. A temperature of 58° C. was determined.

A similar polyethylene coated paper treated under identical conditions in the size press with an aqueous solution containing only 8 weight-% of sodium chloride (without starch) showed after equal treatment with microwaves a surface temperature of 45° C.

From the foregoing description, one skilled in the art can easily ascertain the essential characteristic of this invention and, without departing from the spirit and scope thereof, can make various usages and conditions. For example, it would be possible to apply the combined starch-salt-solution also to one side of the paper only if temperature increase is desired only on one side of the paper.

It is to be understood that the foregoing only relates to the preferred embodiments of the invention and is offered by way of illustration, rather than of limitation, and that numerous substitutions, modifications and alterations are contemplated without departing from the scope of the invention defined by the appended claims.

What is claimed and desired to be secured by Letters Patent of the United States is:

1. Sheet material comprising a paper core, an aqueous layer applied on both sides of the paper core including a mixture having in combination therein 0.25 to 5 grams of starch or starch derivative and 20 to 30 mVal of NaCl or KCl per square meter as an aqueous solution containing starch, said sheet material during drying being enhanced by microwave radiation and whereafter a layer of synthetic resin is coated onto said applied aqueous layer.

2. Sheet material of claim 1 wherein said synthetic resin is polyethylene or polypropylene.

3. Sheet material of claim 1 wherein the starch is corn starch.

4. Sheet material of claim 3 wherein the corn starch is present in an amount of 0.5 to 5 grams per square meter.

5. Sheet material of claim 1 wherein KCl is the salt.

6. Sheet material of claim 1 in which at least one of the synthetic resin layers is coated with at least one photographic emulsion layer.

7. Sheet material of claim 1 wherein said synthetic resin is polyethylene or polypropylene; said starch derivative is oxidized corn starch which is present at a level of 0.5 to 5 grams per square meter.

8. Sheet material of claim 1 wherein said synthetic resin is polyethylene or polypropylene and the salt is KCl which is present in an amount of 5 to 30 mVal per square meter of the sheet material.

9. A method of preparing and drying a sheet material comprising:

applying onto both sides of a paper core an aqueous layer including a mixture having in combination therein 0.25 to 5 grams of starch or starch derivative and 2 to 30 mVal of NaCl or KCl per square meter as an aqueous solution containing starch, enhancing the sheet by microwave radiation during drying and thereafter coating the sheet upon each side thereof with a layer of synthetic resin disposed upon said applied aqueous layer.

10. Method of claim 9 wherein said synthetic resin is polyethylene or polypropylene.

11. Method of claim 9 wherein the starch is corn starch.

12. Method of claim 11 wherein the corn starch is present in an amount of 0.5 to 5 grams per square meter.

13. Method of claim 9 wherein KCl is the salt.

14. Method of claim 9 in which at least one of the synthetic resin layers is coated with at least one photographic emulsion layer.

15. Method of claim 9 wherein said synthetic resin is polyethylene or polypropylene; said starch derivative is oxidized corn starch which is present at a level of 0.5 to 5 grams per square meter.

16. Method of claim 9 wherein said synthetic resin is polyethylene or polypropylene and the salt is KCl which is present in an amount of 5 to 30 mVal per square meter of the sheet material.

17. Sheet material of claim 1 wherein said sheet material during treatment by said microwave radiation of the sheet material is heated to a surface temperature value substantially in excess of temperature values where salt and starch reside alone in said aqueous layer and similarly being subjected to microwave radiation.

18. Method of claim 9 wherein said sheet material during treatment by said microwave radiation of the sheet material is heated to a surface temperature value substantially in excess of temperature values where salt and starch reside alone in said aqueous layer and similarly being subjected to microwave radiation.

* * * * *